United States Patent [19]

Masson

[11] Patent Number: 5,038,831

[45] Date of Patent: Aug. 13, 1991

[54] FLOOD STOPPER FOR DRAIN SYSTEMS

[76] Inventor: Luis Masson, 5505 S. Komensky, Chicago, Ill. 60629

[21] Appl. No.: 356,176

[22] Filed: May 24, 1989

[51] Int. Cl.[5] ..... F16L 55/12

[52] U.S. Cl. ..... 138/93; 137/403; 137/421; 73/307

[58] Field of Search ..... 138/93, 89; 137/421, 137/557; 73/307; 116/110, 112, 118; 15/104.31; 141/208, 209

[56] References Cited

U.S. PATENT DOCUMENTS

| | | | |
|---|---|---|---|
| 2,549,204 | 4/1951 | Kaddatz | 137/362 |
| 2,793,371 | 5/1957 | Vesconte | 137/362 |
| 4,432,388 | 2/1984 | Rest | 138/93 |

*Primary Examiner*—Harvey C. Hornsby
*Assistant Examiner*—P. Brinson
*Attorney, Agent, or Firm*—Terry M. Gernstein

[57] ABSTRACT

A flood stopper system is used to prevent movement of fluid from a floor drain system out onto a floor that is being cleared by that drain system. The flood stopper system includes a balloon-like inflatable element that is automatically inflated to occlude the drain system in the event of a flood situation. The stopper system is located in the drain in a stand-by configuration and includes a float that covers a fluid-sensor and is only moved when a potential flood situation is present. Movement of the float permits fluid to contact the sensor and upon such contact, the sensor generates a signal that is used to fluidically connect a source of pressurized gas to the inflatable element to occlude the drain system.

3 Claims, 1 Drawing Sheet

FLOOD STOPPER FOR DRAIN SYSTEMS

TECHNICAL FIELD OF THE INVENTION

The present invention relates to the general art of plumbing, and to the particular field of drains. Specifically, the present invention relates to drain stoppers.

BACKGROUND OF THE INVENTION

Many homeowners and apartment renters have experienced the nightmare of a floor drain backing up and conducting water and/or sewage into their property. Such drain back up can be caused by flood conditions in the area or the like. Whatever the cause, the resulting mess is disastrous and could present a health hazard.

While there are many designs for occluding large mains, see for example, U.S. Pat. Nos. 1,760,750 and 1,814,677, and for stopping a water pipe to permit a cleaning process to be conducted, see, for example, U.S. Pat. Nos. 3,000,636 and 2,309,429, such devices are inserted manually when it is desired to occlude the main or drain.

Thus, while such devices are effective when used, they have a serious shortcoming with regard to the above-mentioned flooding problem. This shortcoming revolves around the need for the user to control the situation. That is, the user must be there to operate the device. Many flood situations caused by a drain backing up occur when the homeowner is not present, and progress to a disastrous degree before that homeowner ever becomes aware of the situation.

If the homeowner is not present at the beginning of the situation, the effectiveness of the above-mentioned type of stoppers is extremely limited since a great deal of damage may have already occurred before these stoppers are ever even used.

Accordingly, there is a need for a flood stopper type of drain plug that can automatically stop a drain from conducting water or other fluid back into a room or area which is supposed to be cleared by such drain.

OBJECTS OF THE INVENTION

It is a main object of the present invention to provide a flood stopper which automatically prevents a drain from conducting fluid backwards into a room or area which is being cleared by that drain.

It is a main object of the present invention to provide a flood stopper which automatically prevents a drain from conducting fluid backwards into a room or area which is being cleared by that drain and which includes an alarm for alerting someone of a flood condition.

It is a main object of the present invention to provide a flood stopper which automatically prevents a drain from conducting fluid backwards into a room or area which is being cleared by that drain and which includes an additional seal for ensuring that the drain is stopped even if the back pressure is quite high.

SUMMARY OF THE INVENTION

These, and other, objects are achieved by a stopper assembly which is mounted in a floor drain and which automatically occludes that floor drain upon sensing a potential flood condition. The stopper assembly also includes an alarm for signalling the existence of such a flood condition, and an additional sealing means which is used to ensure a fluid-tight seal of the drain even if the back-pressure on the seal is extremely high.

DETAILED DESCRIPTION OF THE PREFERRED EMBODIMENT OF THE INVENTION

Figure 1:
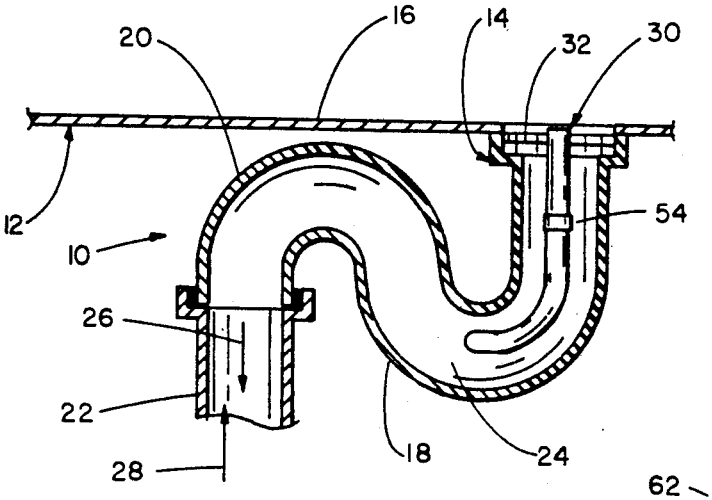
FIG. 1 is a schematic of a floor drain with the flood stopper assembly mounted therein and in an inactivated configuration.

Shown in FIG. 1 is a floor drain system 10 for maintaining a floor 12 clear of fluid, such as water, or the like. The floor drain system 10 includes a drain element 14 mounted in the floor 12 to be lower than the upper surface 16 of that floor, and a conduit 18 having a trap 20 therein for conducting the fluid away to a suitable location via a connecting conduit 22.

The drain system 10 operates in the normal manner to conduct fluid from the floor 12 to clear that floor, and fluid 24 is indicated in the drain system. The normal action of the drain system 10 in conducting fluid, such as water, away from the floor is indicated in FIG. 1 by fluid flow direction 26.

However, in the event that there is a stoppage in the line 22 or at some other location downstream (with reference to the flow direction 26) of the drain 14, fluid 24 may have a tendency to stand in the lines 18 and 22 thereby allowing fluid to build up on the floor surface 16 and not be cleared by the drain system 10. Such a situation is undesirable.

Also, if there is some occurrence in the lines downstream of the drain system that causes water or other fluid in the lines located downstream of a homeowner's property to move in a direction reversed from the flow direction 26, a disastrous situation may occur. That is, if for some reason, such as a flood condition in the area of the home, or the like, fluid moves in the direction 28, such fluid may flow back out of the drain 14. Such fluid may be quite unhealthful, and may even contain sewage, and should not be permitted to flow onto the floor 12.

Simply occluding the drain system 10 may prevent fluid flowing in the direction 28 from moving onto the floor 12, and this is accomplished by flood stopper assembly 30 embodying the present invention. However, as discussed above, since the flood stopper assembly must be activated to be effective, it should be activated immediately upon the occurrence of such a flood condition and should not be dependent on manual activation to occlude the drain system. However, the flood stopper assembly 30 should not interfere with the normal operation of the drain system, including the situation where water is simply standing in the system and not flowing back onto the floor in direction 28.

Thus, the flood stopper assembly 30 is adapted to automatically actuate and occlude the drain system 10 upon the fluid in that system moving in direction 28 with enough force to move out onto the floor, and to permit fluid in that drain system to flow in the direction 26 or to stand without being activated to occlude the drain system 10.

The flood stopper assembly 30 is adapted to be mounted in the drain system 10 at all times so that it will always be in a stand-by configuration ready to be actuated to occlude the drain system in the event fluid in that system begins to move in a floor flooding manner.

Thus, the assembly 30 includes a support element 32, such as a spider or the like, which is mounted in the floor drain 14 and which is constructed to include fluid passage means that permit fluid to freely move through that drain from the floor in a floor-clearing manner.

Figure 2:
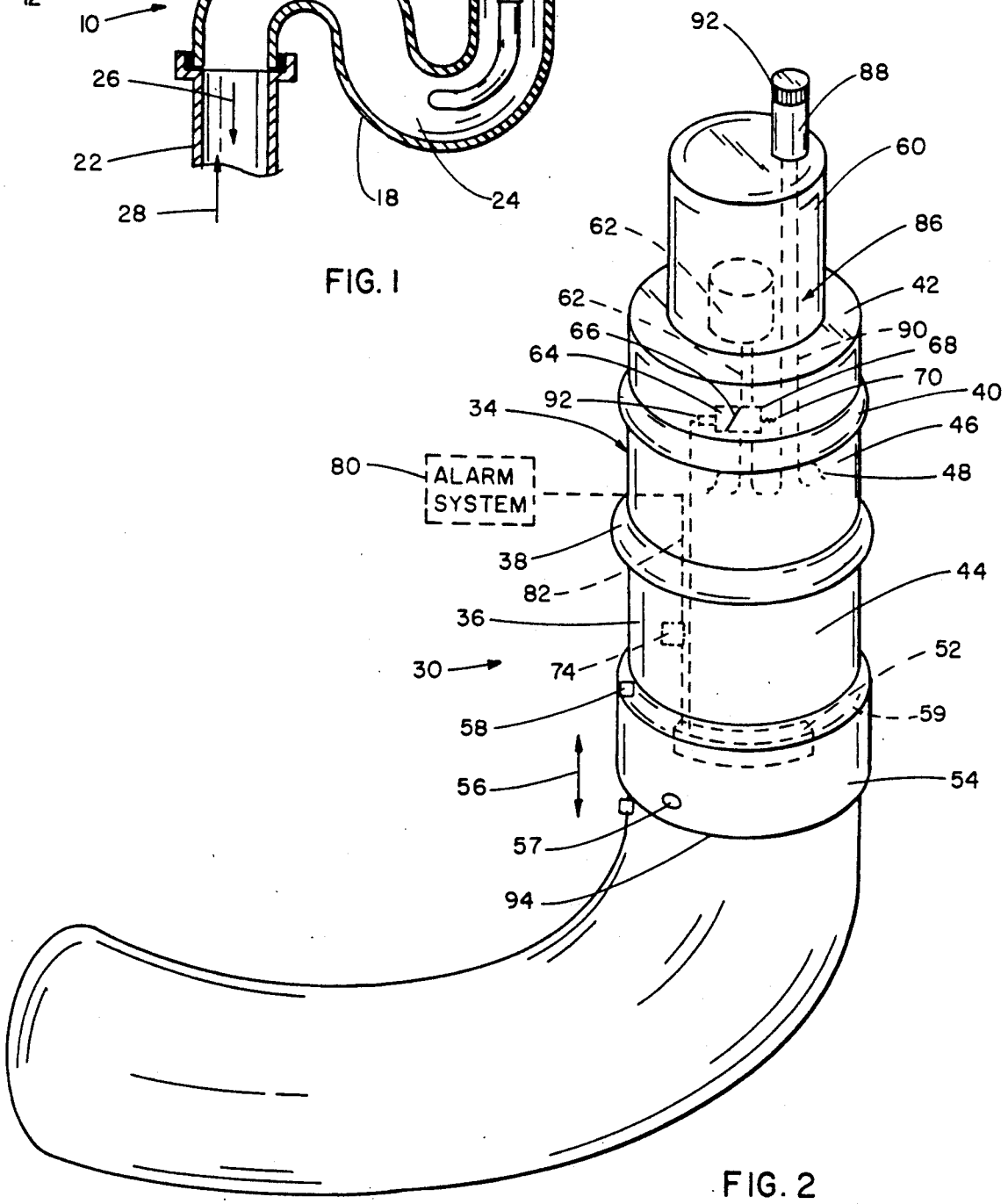
FIG. 2 is a perspective of the flood stopper assembly embodying the present invention in an activated configuration.

Referring to FIG. 2, it is seen that the flood stopper assembly 30 further includes a frame unit 34 that is adapted to be affixed to the support element 32 (not shown in FIG. 2) and which is configured to extend into the drain system conduit 18. The frame unit preferably is cage-like to include a plurality of bars, such as bar 36, dependingly connected to a plurality of support rings, such as rings 38 and 40, and to a top mounting cap 42.

The assembly 30 further includes an inflatable balloon-like element 44 that has an inlet end 46 having an inflation valve 48 for use in inflating that element. The element 44 is mounted on the frame unit. The inflation valve 48 is shown schematically in FIG. 2, and is large enough to accommodate additional elements as will be apparent from the ensuing discussion. The valve 48 is a one-way valve that permits fluid to move into the element 44 but prohibits such fluid from moving out of the element. The element 48 can be attached to the support ring 40.

The element 44 is adapted to assume a relaxed, stand-by configuration as shown in FIG. 1, or to be automatically inflated into the FIG. 2 drain-occluding configuration upon the fluid in the drain system beginning to move in direction 28 with enough force to flood onto the floor 16.

To this end, the assembly 28 includes an inflating means connected to the element 44 which automatically operates upon sensing fluid in the drain system flowing in direction 28 with enough force to flood out of the drain 14, but does not operate if the fluid is moving in direction 26 or is not moving at all or simply moves slightly in the direction 28 but is essentially stagnant.

The inflating means includes a fluid-sensing element 52 mounted on the frame unit in position to be in the conduit 18. The fluid-sensing element 52 can be any suitable device, and can be selected by someone skilled in the measurement art based on the present disclosure. The element 52 is mounted on a plate that is affixed to the bars 36.

The fluid-sensing element 52 is covered by a float element 54. The float 54 is movably mounted on the frame unit bars 36 to move up or down as indicated by the double-headed arrow 56. The float covers the sensing element 52 in a fluid-tight manner to prevent water or any other fluid that might be present in the drain system, from contacting the sensing element 52 when the float is in an element-covering position, as indicated in FIG. 2. Suitable wiper-type seals on the inside of the float adjacent to the element 52 are used. Such seals slidingly contact the plate on which the sensing element is mounted to permit movement of the float while continuing to seal the sensing element between the float and the plate on which it is mounted.

The float 54 is constructed of material, such as cork or the like, that floats, but also is weighted so that it will not float upwardly toward the drain 14 in stagnant fluid. Weight means, such as metal plug 57 can be added to the float to achieve the desired operation of that float. The sliding seal between the float and the sensing element also contributes to this objective. In this manner, the float 54 will not move upwards towards the drain 14 from the FIG. 2 position until the fluid in the drain system begins to flow in the direction 28, and will remain in the FIG. 2 position covering the sensing element 52 in a fluid-tight manner if the fluid in the drain system is either stagnant, essentially stagnant or is moving in direction 26. By selecting the density and specific weight of the float material, as well as the friction factors of the float and the frame unit, that float can be designed to operate in the above-discussed manner. Those skilled in the art will be able to make such selections based on the present disclosure. Suitable stops, such as stop 58 on a rod 36 and engaging a top annular surface 59 of the float when that float is in the sensing element covering position, are also included to ensure that flow movement of the fluid in the drain system in direction 26 will not pull the float out of the FIG. 2 position. The stops also prevent the float from moving downwardly away from the sensing element covering position when fluid in the drain system drops below the level of the float.

A cover 60 is mounted on the cap element 42, and has a container 62 stored therein. The container 62 stores compressed gas, such as compressed air or the like, for inflating the element 44 upon establishing fluid communication between that container and the inside of the element 44. The cover is removably mounted on the plate element 42 so that the container can be checked and/or replaced as necessary. A threaded connection between the cap and the cover will suffice for this purpose.

The source of compressed gas is fluidically connected to the element 44 by a conduit 62 and a normally closed solenoid operated valve unit 64. The valve unit 64 includes a valve element 66 located inside a housing 68 and fluidically interposed between the source of compressed gas and the inflatable element 44. The valve element 64 is biased toward a closed, fluid flow interrupting position shown in FIG. 2 by a biasing means, such as a spring 70. A solenoid means 72 is also mounted on the housing 68 and is electrically connected to the fluid-sensing element 52 to receive a signal therefrom as soon as that sensing element senses fluid.

Upon receiving a signal from the sensing element 42, the solenoid operates to overcome the bias of the element 70 and force the valve element 66 from the closed position to a position that opens the conduit 62 to fluidically connect the source of pressurized gas to the inflatable element 44 to inflate that element from the FIG. 1 stand-by configuration into the FIG. 2 operative, drain-occluding position. A suitable control unit 74 is included in the electrical circuit between the sensing means and the solenoid to operate on the signal from the sensing means and condition it as necessary for controlling the operation of the solenoid as desired for the operation of the assembly 30.

A suitable alarm system 80 is connected to the electrical circuit which includes the sensing element 52 to signal, audibly and/or visually, that the sensing element 52 has activated the occluding function of the system 30. This alarm system can be connected either directly to lead 82 connecting the sensing element to the solenoid as shown in FIG. 2, or to the control element 74. The alarm system can be located adjacent to the system or 30 can be located remotely therefrom within the premises in position to ensure that the owner, or other such person, will be alerted of the actuation of the system 30.

A further system 86 is included in the system 30 to ensure the fluid-tight integrity of the actuated drain-occluding system 30. The further system 86 is manually activated, and includes a valve stem 88 mounted on the cap 42 and fluidically connected to the inflatable element 44 by a conduit 90 leading to the valve 48. The stem 88 is adapted to be connected to a suitable pump, such as a bicycle pump or the like, to add pressure to the inflation of the element 44. A closure cap 92 is included on the stem, and the stem can be any suitable length.

Operation of the system 30 is as follows. The system is normally in the FIG. 1 stand-by condition with the inflatable element collapsed so that fluid can flow through the drain system in the normal, downstream direction 26. This flow direction will co-operate with the weight means in the float to bias the float 54 downwardly into a fluid-tight seal over the fluid sensing element 52 in such a normally functioning condition of the drain system 10.

Should fluid in the drain system 10 become stagnant and not flow in the direction 28, the weight means 57 will prevent the float from moving away from a fluid-tight sealing position over the sensing element 52. In this manner, a simple stoppage of flow through the drain system 10 will not actuate the system 30. As will be evident from the present discussion, the weight of the weight means is selected so that the flow force exerted on the float, especially on float leading surface 94, by the fluid in the drain system moving in direction 28 will only be strong enough to move that float away from the sensor covering position shown in FIG. 2 when that flow is sufficient to cause fluid to move out of the drain onto the floor 12. Thus, a slight movement of stagnant fluid in direction 28 will not be sufficient to actuate the system 30; whereas, a flow of fluid in direction 28 will actuate the system 30.

However, should the fluid in the system 10 begin to move in direction 28, this flow will exert a flow-induced pressure on the float, especially on the surface 94 of that float, which adds to the upward force of the natural buoyancy of that float to exert an upward force on the float. As soon as the flow in direction 28 is strong enough to cause fluid to move out of the drain 14 and onto the floor, this flow will have a flow force on the float that is strong enough to overcome the downward force on that float associated with the weight means and the friction associated with the seals of the float and move the float upwardly away from the FIG. 2 sensing element covering position.

Once the float moves out of covering position over the sensing element, that sensing element sends a signal to the control valve solenoid 72 and that solenoid causes the valve to open and fluidically connect the source of pressurized gas to the inflatable element 44 to inflate that element.

The signal generated by the sensing element 52 is also used to actuate the alarm system 80.

Once actuated, the system 30 occludes the drain system 10 to prevent fluid from that system from flowing out onto the floor surface 16. Upon being notified of the flood condition, the homeowner can connect a pump or other source of pressurized gas to the system 30 via the stem 88 to add inflating pressure to the element 44 to ensure that even a high back flow pressure will not cause fluid from the drain system 10 to by-pass the inflated element 44.

It is understood that while certain forms of the present invention have been illustrated and described herein, it is not to be limited to the specific forms or arrangements of parts described and shown.

I claim:

1. A flood stopper assembly for use in preventing flooding via a floor drain system comprising:

A) a support element which can be mounted in a drain element of a floor drain system and which permits fluid to move into that floor drain system from a floor being cleared by the floor drain system;

B) a frame unit affixed to said support element to extend into a conduit element of the floor drain system that is connected to the drain element;

C) an inflatable balloon-like element attached to said frame unit to be located in the conduit element to occlude that floor drain system when inflated;

D) inflating means connected to said balloon-like element, said inflating means including (1) fluid-sensing means on said frame unit, (2) a float element movably mounted on said frame unit to cover said fluid-sensing means in a fluid-tight manner and being formed of material that will float in the fluid in the drain system and having weight means which biases said float element into a fluid-sensing means covering position, said weight means being light enough so that fluid movement out of the drain element towards the floor in co-operation with the floatable material will overcome the bias of said weight means to move said float element away from the fluid-sensing means covering position to expose said fluid-sensing means to fluid in the drain system, (3) a source of pressurized gas mounted on said frame unit, and (4) a valve unit fluidically connecting said source of pressurized gas to said balloon-like element and including (a) a housing, (b) a valve element in said housing, (c) means biasing said valve element into a closed position blocking flow from said source of pressurized gas to said balloon-like element, (d) solenoid means on said housing and connected to said valve element to overcome said closing bias to open said valve element and establish fluid communication between said source of pressurized gas and said balloon-like element when said solenoid means is actuated, and (e) solenoid means actuating means connected to said fluid-sensing means to actuate said solenoid means when fluid is sensed by said fluid-sensing means whereby said valve unit is opened and pressurized fluid is transferred from said source of pressurized gas to said balloon-like element to inflate same and occlude the floor drain system.

2. The flood stopper assembly defined in claim 1 further including an alarm system connected to said inflating means.

3. The flood stopper assembly defined in claim 2. wherein said inflating means further includes a valve stem mounted on said frame unit and a passage fluidically connecting said valve stem to said balloon-like element.

* * * * *